United States Patent [19]

Zodrow

[11] 4,092,206

[45] May 30, 1978

[54] LABELLING MACHINE

[75] Inventor: Rudolf Zodrow, Dusseldorf, Germany

[73] Assignee: Jagenberg-Werke Aktiengesellschaft, Dusseldorf, Germany

[21] Appl. No.: 779,104

[22] Filed: Mar. 18, 1977

[30] Foreign Application Priority Data

May 3, 1976 Germany ..... 2619067

[51] Int. Cl.[2] ..... B65C 9/00

[52] U.S. Cl. ..... 156/568; 118/231; 156/571; 156/DIG. 32; 271/33; 271/115

[58] Field of Search ..... 156/567, 568, 571, 578, 156/DIG. 29, DIG. 30, DIG. 32; 271/33, 95, 115, 270, 264; 118/220, 231, 236, 240

[56] References Cited

U.S. PATENT DOCUMENTS

| | | | |
|---|---|---|---|
| 3,546,047 | 12/1970 | Dullinger | 156/571 |
| 3,735,731 | 5/1973 | Tavernier | 156/571 X |
| 3,919,040 | 11/1975 | Zodrow | 156/571 |
| 3,923,589 | 12/1975 | Tavernier | 156/571 X |
| 3,928,120 | 12/1975 | Zodrow | 156/571 X |

*Primary Examiner*—William A. Powell
*Assistant Examiner*—M. G. Wityshyn
*Attorney, Agent, or Firm*—Burgess, Dinklage & Sprung

[57] ABSTRACT

A labelling machine comprises a revolving carrier with at least one pickup element rotatably mounted thereon. A stationary sun gear is provided and the drive for each pickup element includes a drive spindle, a pinion meshing with the sun gear and axially displaceable with respect thereto and coupled to the drive spindle. The coupling includes a cam-controllable compensating drive which comprises two opposite cam pieces which are axially displaceable with respect to the drive spindle and connected for rotation with the pinion, at least one driver disposed between the cam pieces for driving the spindle in response to the rotation of the pinion and axially settable to eliminate free play. Cam control for the compensating drive comprises an axial cam and a bipartite cam follower which is mounted for axial adjustment to eliminate free play.

5 Claims, 4 Drawing Figures

LABELLING MACHINE

BACKGROUND OF THE INVENTION

The invention relates to a labeling machine having a revolving carrier on which at least one pickup member having an outwardly curved pickup surface for labels is rotatably mounted, and having a drive for each pickup member, said drive consisting of a fixed sun gear and a pinion meshing with the sun gear and displaceable axially in relation to the sun gear, the said pinion being coupled to the drive spindle of the pickup member by a cam-controlled compensating drive.

In a known labelling machine of this kind disclosed in U.S. Pat. No. 3,928,120, the compensating drive consists of a steep spiral between the pinion and the drive spindle of the pickup member. The cam control for the compensating drive consists of an axial cam member having a groove in which a cam follower member constructed as a roller is guided. The cam-controlled compensating drive brings about a result that, if the angular velocity of the carrier is constant, the angular velocity produced by the axial displacement of the pinion on the steep spiral is superimposed upon the constant angular velocity produced by the planetary drive, so that the rotatory movement of the pickup member is not regular but is accelerated and retarded. This acceleration and retardation of the pickup member is necessary in order to obtain at the various stations of the labelling machine, such as the label magazine, the glue roller and the labeling cylinder, a complete rolling of the cylindrically curved pickup surface of the pickup member mounted between the center of the curvature and the pickup surface.

The desired complete rolling of the pickup members on the label stack, and especially the rolling of the pickup member upon the transfer of the labels to the labeling cylinder is dependent upon the free play in the steep spiral and in the groove in the cam member as created by design or resulting from manufacturing tolerances. In the course of operation, such free play can increase to such an extent that a sufficient rolling action, especially at high outputs, is no longer assured.

SUMMARY OF THE INVENTION

The object of the present invention is to provide a labelling machine in which the rolling action is not impaired by the cam-controlled compensating drive, especially by the free play produced by manufacturing tolerances and wear.

This object is achieved in accordance with the present invention by providing two opposite ramp pieces that are affixed corotationally to a pinion, and at least one driving member which is disposed between them, the said ramp pieces being adjustable with respect to the driver or a two-piece driver which is axially adjustable on the said ramp pieces to eliminate free play, and a cam control of the compensating drive which has an axially acting recessed or raised cam track or groove to which a bipartite cam follower is axially adjustable to eliminate free play, or which is bipartite and is adjustable axially in relation to a cam follower to eliminate free play.

In the labelling machine of the invention, the free play resulting from design, and/or from production tolerances, or due to wear, can be reduced virtually to zero, so that the cam control produces a very precise acceleration and retardation of the pickup members during the rotation thereof. This assures that, even in the case of very high outputs, the picking up of the labels from the label stack and the transfer of the labels to the labeling cylinder will take place in an undisturbed manner.

To minimize wear on the ramp pieces and on the cam control, the driver, in accordance with certain embodiments of the invention, can comprise two confronting rollers and the cam follower cam comprise two opposed rollers preferably gripping the cam track between them. The reduced wear on the drivers and ramp pieces on the one hand and on the cam follower and cam track on the other hand, results from the fact that the rollers rotate in only one direction regardless of which of the rollers is bearing the load. If only a single roller serves as the cam follower riding in a groove, the direction of rotation of the roller will change according to the direction of application of the force.

BRIEF DESCRIPTION OF THE DRAWINGS

The invention will be further explained with the aid of drawings representing an embodiment thereof, in which.

DETAILED DESCRIPTION OF THE PREFERRED EMBODIMENTS

Figure 1:
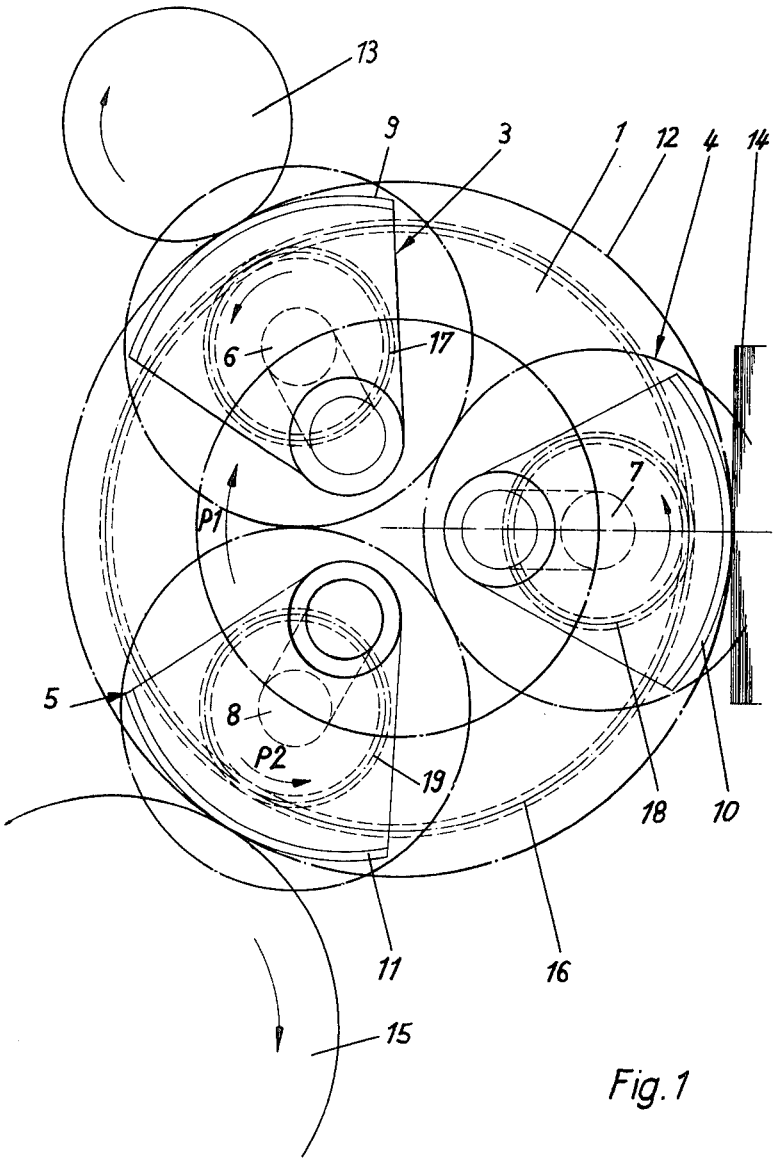
FIG. 1 is a diagrammatic top plan view of a labelling machine.
Figure 2:
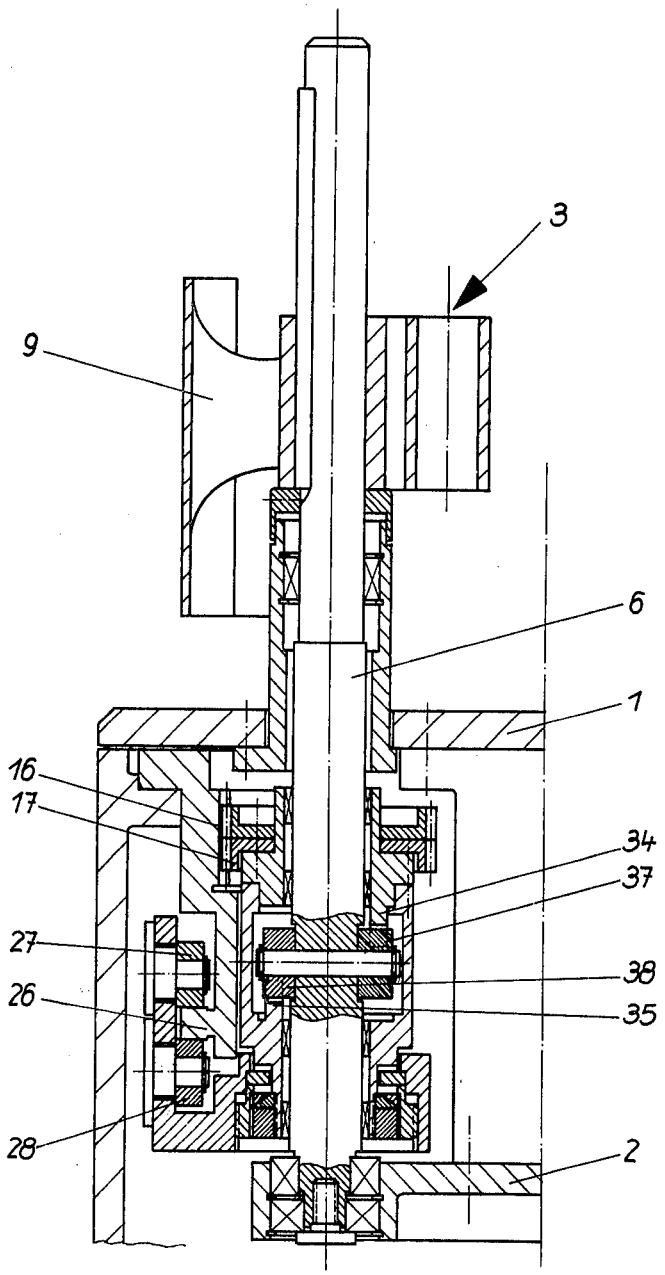
FIG. 2 is an axial cross-sectional view taken through a pickup member.
Figure 3:
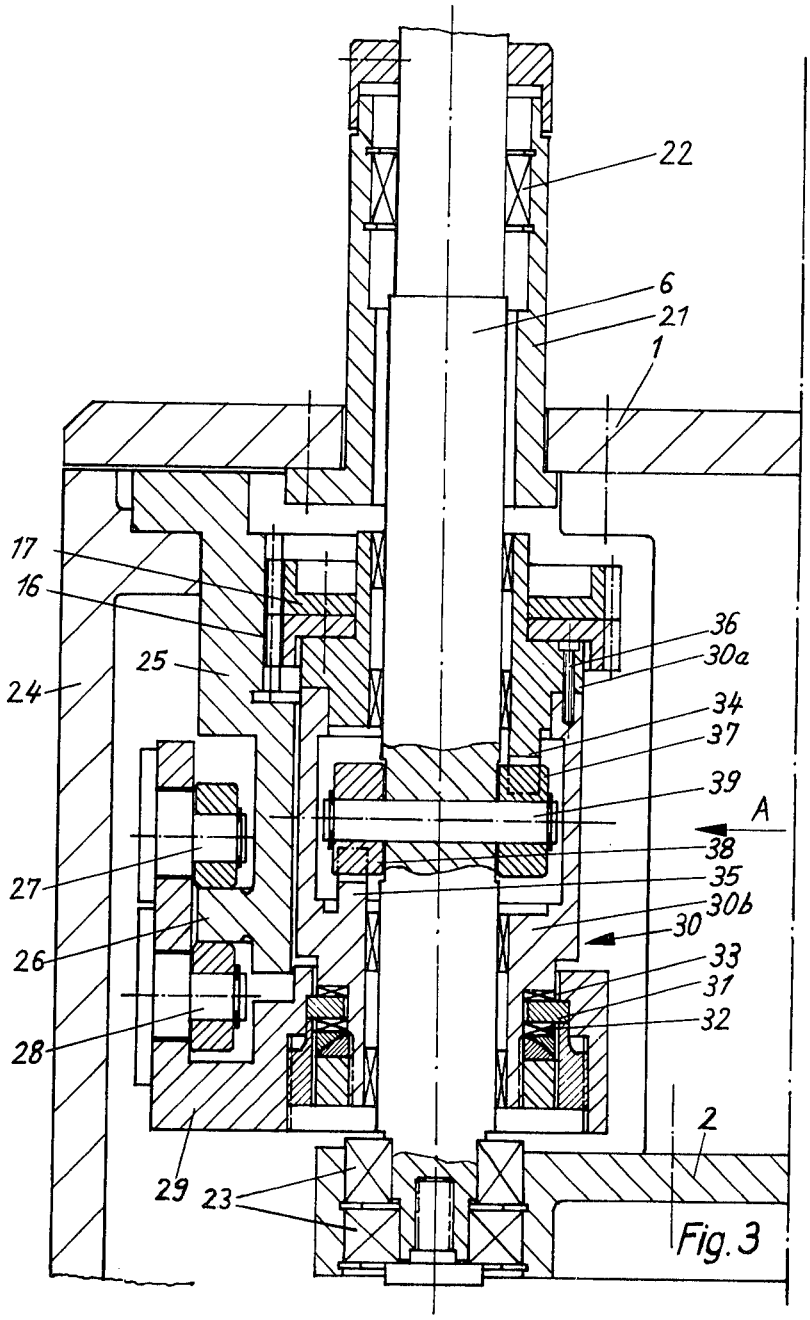
FIG. 3 is an enlarged axial cross-sectional view taken through the drive and the cam control of the pickup member of FIG. 2.

The labelling machine represented in FIGS. 1–4 has as a carrier an upper circular plate 1 and a lower circular plate 2, in which the drive spindles 6, 7 and 8 are rotatably mounted for the driving of pickup members 3, 4 and 5. The drive spindles 6 - 8 are disposed in symmetry with respect to the cylindrically curved pickup surfaces 9, 10 and 11 and between the said pickup surfaces 9, 10 and 11 and the center of their curvature. The various stations, namely a rotating glue roller 13, a stationary label stack 14 whose front face is flat, and a rotating labelling cylinder 15, are disposed tangentially to the circle 12 described by the pickup surfaces 9, 10 and 11 in their centered position.

A stationary sun gear 16, with which mesh the pinions 17, 18 and 19 disposed on the drive spindles 6, 7 and 8, serves as the means for driving the pickup members 3, 4 and 5. When the carrier 1, 2 rotates in the direction of the arrow $P_1$, the pickup members 3, 4 and 5 will thus revolve in the direction of the arrow $P_2$, and hence opposite to the direction of rotation of glue roller 13 and the labelling cylinder 15. Each drive spindle 6 is rotatably mounted, but supported against axial displacement, by means of a sleeve 21 with bearing 22, which is inserted into the upper plate 1, and by means of bearings 23 in the lower plate 2. The stand 24 of the labelling machine bears a stationary annular component 25 containing internally in its upper portion the fixed sun gear 16 and bearing externally in its lower portion an annular raised cam 26. The raised cam 26 is engaged on both its faces and straddled by a pair of rollers 27–28 which are held on adjustable eccentric journals in a cam follower 29. The cam follower 29 is supported against axial displacement on a part 30 which is rotatably mounted on the drive spindle 6, by the fact that it is gripped at a ring 31 between two axial thrust bearings 32 and 33. In the event of an axial displacement of the bearing bracket 29 produced by the cam 26, part 30 is thus axially displaced on spindle 6.

A pinion 17 meshing with the sun gear 16 is fastened corotationally to part 30 in the upper portion of the latter. The pinion 17 is divided into two parts perpendicularly to its axis, so that the two parts are rotatable against one another. This possibility for turning and setting makes it possible to reduce to zero any clearance between the flanks of the teeth of the sun gear 16 and those of the pinion 17.

Figure 4:
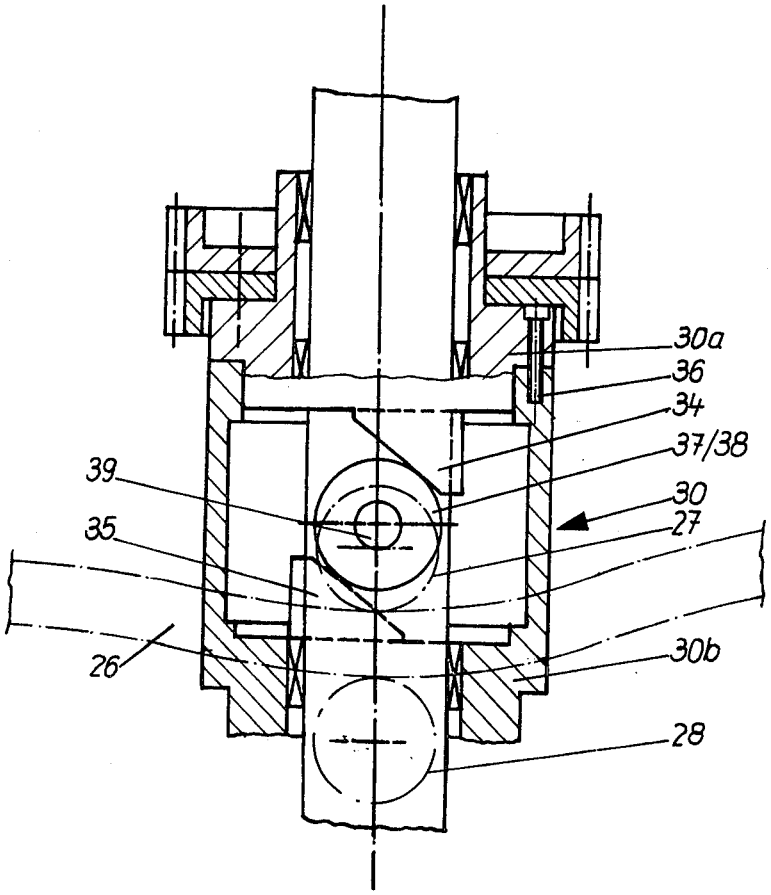
FIG. 4 is a fragmentary cross-sectional view taken through the drive and the cam control of FIG. 3 as seen in the direction of the arrow A.

As best seen in FIG. 4, part 30 has ramps 34 and 35 facing one another on opposite sides of drive spindle 6. The part 30*a* bearing the upper ramp 34 is tightened to the part 30*b* bearing the lower ramp 35 by means of bolts 36 in the manner of a flange. Elongated holes are provided in the upper part 30*a*, so that the upper part 30*a* is rotatable with respect to the lower part 30*b*. By such rotation, the distance between the two ramps 34 and 35 can be adjusted. One of the rollers 37 and 38 which are mounted on a shaft 39 passing through the drive spindle 6 cooperates with each of these two ramps 34 and 35.

Upon the rotation of the carrier 1, 2 the pinion 17 is rotated. The pinion sets into rotation component 30 which transmits the torque to spindle 6 through the ramps 34, 35 and the rollers 37, 38. As long as the cam control 26 – 28 does not axially displace component 30, the rollers 37, 38 do not change their position on the ramps 34, 35. When the carrier 1, 2 rotates at constant angular velocity, the rotation of the pickup members accordingly also takes place at a constant angular velocity. But when component 30 is shifted axially by the cam control 26–28, this results in a displacement of the rollers 37 and 38 on the ramps 34 and 35, and hence in an acceleration or retardation, respectively, of the rotatory movement produced by the pinion 17.

The drive and the cam control can be adjusted to eliminate free play in the labelling machine of the invention. As already explained, this is performed on the one hand through the rotation of the two ramps 34 and 35, and on the other hand through the rotation of the eccentric bearing of rollers 27 and 28. Free play between the sun gear 16 and the pinion 17 can be reduced to zero by rotating the two pinion parts against one another, and free play between the cam follower 29 and the component 30 can be reduced to zero by tightening the ring 31 on part 30.

It will be appreciated that the instant specification is set forth by way of illustration and not limitation, and that various modifications and changes may be made without departing from the spirit and scope of the present invention.

What is claimed is:

1. A labelling machine comprising a revolving carrier; at least one pickup element with an outwardly curved receiving surface for labels rotatably mounted on the carrier; a stationary sun gear; drive means for each pickup element including a drive spindle, a pinion meshing with the sun gear and axially displaceable with respect to the sun gear and means coupling the pinion to the drive spindle including a cam-controlled compensating drive comprising two opposite cams pieces axially displaceable with respect to the drive spindle and connected for rotation with the pinion and at least one driver connected to said spindle and disposed between the cam pieces for driving the spindle in response to the rotation of the pinion, said cam pieces being settable relative to each other in an axial direction with respect to the spindle to eliminate free play; and cam means for controlling the compensating drive comprising an annular cam, a bipartite cam follower and means mounting the cam follower for axial adjustment relative to said cam to eliminate free play.

2. The labelling machine according to claim 1, wherein the driver comprises two diametrically opposed rollers.

3. The labelling machine according to claim 1, wherein the cam follower comprises two axially opposed rollers straddling said annular cam.

4. The labelling machine according to claim 2, wherein the two opposite cam pieces each include a ramped contacting portion cooperating with a different one of the two rollers.

5. The labelling machine according to claim 1, wherein the pinion comprises two superposed pinion elements rotatable against one another whereby free play can be eliminated by relative turning and setting of said elements.

* * * * *